US005377514A

United States Patent [19]

Robbins et al.

[11] Patent Number: 5,377,514

[45] Date of Patent: Jan. 3, 1995

[54] ESCUTCHEON AND METHOD OF MAKING A FIRE-RESISTANT SAFE

[75] Inventors: Richard C. Robbins; Andrew L. Oliveri, both of Rochester; Mary P. DiGiambattista, Penfield, all of N.Y.

[73] Assignee: John D. Brush & Co., Inc., Rochester, N.Y.

[21] Appl. No.: 185,587

[22] Filed: Jan. 21, 1994

Related U.S. Application Data

[60] Division of Ser. No. 78,515, Jun. 16, 1993, Pat. No. 5,295,447, which is a continuation of Ser. No. 811,019, Dec. 20, 1991, abandoned.

[51] Int. Cl.[6] ..... E05B 15/02; E05G 1/024

[52] U.S. Cl. ..... 70/452; 29/455.1; 29/530; 52/267; 52/743; 52/792; 70/466; 109/75; 109/76; 109/80; 220/412; 220/418; 264/263; 264/277; 312/409; 428/921

[58] Field of Search ..... 109/65, 75, 76, 80, 109/49.5, 58, 58.5, 78, 79, 82–85; 220/412, 418, 465, 469; 264/263, 277, 259, 275; 312/409; 428/921; 29/455.1, 530, 527.1, 897, 897.3, 897.32; 52/267, 743, 792, 232, 265, 266, 268, 269, 317; 70/452, 466

[56] References Cited

U.S. PATENT DOCUMENTS

| | | | |
|---|---|---|---|
| 3,192,099 | 6/1965 | Beckman et al. . | |
| 3,256,669 | 6/1966 | Seiwert . | |
| 4,048,926 | 9/1977 | Brush, Jr. et al. | 109/65 |
| 4,263,365 | 4/1981 | Burgess et al. | 428/310 |
| 4,422,386 | 12/1983 | Carpenter | 109/59 R |
| 4,541,545 | 9/1985 | Beattie et al. | 220/431 |
| 4,753,058 | 6/1988 | Ray III | 52/792 |
| 4,770,839 | 9/1988 | Legge | 264/526 |
| 4,778,709 | 10/1988 | Abe et al. | 428/166 |
| 4,805,290 | 2/1989 | Brush, Jr. et al. | 29/434 |
| 4,846,662 | 7/1989 | Leege | 425/522 |
| 4,856,256 | 8/1989 | Tokuzo | 52/805 |
| 4,898,707 | 2/1990 | Arp | 264/515 |
| 4,948,357 | 8/1990 | Legge et al. | 425/522 |
| 4,993,582 | 2/1991 | Arp | 220/469 |
| 5,063,094 | 11/1991 | Legge et al. | 428/35.7 |
| 5,069,358 | 12/1991 | Avery, Jr. | 220/426 |
| 5,102,481 | 4/1992 | Sharp | 156/69 |

FOREIGN PATENT DOCUMENTS

| | | |
|---|---|---|
| 2439239 | 2/1976 | Germany . |
| 2161524 | 7/1987 | Japan . |
| 92014 | 9/1959 | Netherlands . |
| 340655 | 1/1931 | United Kingdom . |

*Primary Examiner*—Lloyd A. Gall
*Attorney, Agent, or Firm*—Eugene Stephens & Associates

[57] ABSTRACT

A fire-resistant safe is made with internal and external shells that are filled with insulation material. Hollow reinforcements interconnecting the two shells are formed as cone-shaped recesses in the internal shell having truncated bottom portions attached to the external shell. The insulation is made of a water-bearing material and the recesses are made of a resin material that melts at a temperature in excess of the boiling point of water. Funnels are formed in the external shell for adding the insulation material in a liquid state. An escutcheon for covering the funnels is anchored to the insulation material by stakes that are embedded in the insulation material before the material hardens into place.

17 Claims, 7 Drawing Sheets

ESCUTCHEON AND METHOD OF MAKING A FIRE-RESISTANT SAFE

RELATED APPLICATIONS

This is a Division of Application Ser. No. 08/078,515, filed Jun. 16, 1993, U.S. Pat. No. 5,295,447, which is a continuation of application Ser. No. 07/811,019, filed Dec. 20, 1991, now abandoned. Both of these related applications are hereby incorporated by reference.

TECHNICAL FIELD

Our invention relates to the field of insulated storage containers for protecting contents from damage by fire.

BACKGROUND

Fire-resistant storage containers, also referred to as fire-resistant safes, are generally constructed with internal and external shells that encapsulate spaces filled with insulation material. The internal shells form inner surfaces of the safes, and the external shells form outer surfaces of the safes. Together, the internal and external shells form a shuttering for molding the insulation material in place within the shells. The insulation material is generally made of a mixture that solidifies in the mold but retains a large amount of water within the solidified mass of material.

The internal and external shells are often fabricated from steel sheets, but can also be made as integral double-walled shells that are blow molded from a resin material. Several patents commonly assigned herewith describe the double-walled shells, blow molding processes for making the double-walled shells, and apparatus specially designed for carrying out the blow molding processes. These patents include: U.S. Pat. Nos. 4,770,839 and 4,846,662 to Legge; U.S. Pat. No. 4,948,357 to Legge et al.; U.S. Pat. No. 4,805,290 to Brush, Jr., et al.; and U.S. Pat. Nos. 4,898,707 and 4,993,582 to Arp. All of these patents are hereby incorporated by reference. Separate double-walled shells of resin material are used to form a body of the safes having an opening for receiving contents and a closure (e.g., door, cover, drawer head) for closing the opening in the safe body. The respective double-walled resin shells of the safe body and the closure are both filled with insulation material. Although the resin material is combustible and the external shells of the safe body and the closure burn away in a fire, thereby exposing the insulation material, resin material between the body and the closure only partly melts away, leaving a seal around the opening between the body and the closure. The resin seal resists the conduction of heat and the passage of hot gases into the safes.

Several other advantages also accrue from use of resin material to form the internal and external shells of fire-resistant safes. For example, the resin shells provide a good vapor barrier to retard evaporation of water from the insulation material in both the safe body and the closure. Also, the resin material is lightweight, but resists abrasion and can be molded to a wide variety of shapes and textures.

However, when used as shutters for holding the insulation material in place while the insulation material cures and solidifies, the internal and external shells of resin material tend to bow apart, creating variations in the volume of insulation material required to fill the shells. Accordingly, it has been necessary to overfill the shells to prevent gaps from forming between the solidified insulation material and the resin shells.

Each of the double-walled shells of resin material is molded with a pair of funnels that are used to help fill the shells with the insulation material. Initially, the funnels are molded as closed projections but, thereafter, are cut open by a sawing operation at a predetermined height above the shells. One of the funnels (the larger of the two) guides insulation material into the shells. The other funnel allows air to escape from the shells while the shells are being filled. Air gaps between the insulation material and the resin shells are prevented by overfilling the shells so that the insulation material rises a considerable height (i.e., two centimeters or more) within the funnels.

The insulation material within the double-walled shells can be initially cured at elevated temperatures. This significantly reduces the total amount of time required to cure the insulation material. While curing, the double-walled shells of the safe body and the closure are braced together to maintain a tolerance for flatness of the respective external shells. The bracing is not removed until the insulation material is sufficiently cured to hold its desired shape.

After the insulation material has cured to a solid state, a second sawing operation is used to trim the funnels filled with insulation material to a limited height (i.e.. less than one centimeter) above the double-walled shells. Following this, holes are drilled through the resin shells and insulation material for attaching a latching mechanism, and other holes are drilled through the insulation material within the funnels for attaching escutcheon plates covering the latching mechanisms and the funnels.

The sawing and drilling operations through both the resin material and the solidified insulation material are especially difficult because of the different cutting characteristics of the two materials. Accordingly, it is not possible to use tooling that is especially suited for cutting either material. The operations are also messy and time consuming. In addition, speed nuts or other fasteners for anchoring the escutcheon plates are clearly visible against the internal shells.

SUMMARY OF INVENTION

Contrary to expectations that forming holes through the insulation material of fire-resistant safes would undermine the safes' ability to protect contents from fire, our invention involves perforating the insulation material with hollow resin reinforcements that do not appreciably diminish the fire-resistant qualities of the safes. The hollow reinforcements interconnect internal and external shells of the fire-resistant safes for maintaining a predetermined spacing between the shells while the insulation material within the shells cures and solidifies. The hollow reinforcements are made in one of the shells as recesses having bottom portions that are attached to the other of the shells.

For example, the recesses can be made in the internal shells as truncated cone-shaped projections that are attached to the external shells. The insulation material filling the shells is preferably a water-bearing material for absorbing heat energy by vaporization, and the internal shells are preferably made of a resin material that melts at a temperature above the boiling point of water.

Although the cone-shaped projections form holes through the insulation material, the cones are designed to detach from the external shells upon exposure to a predetermined amount of heat and to contract within the holes toward a planar shape upon continued absorption of heat. The rate of contraction parallels the vaporization of water from the surrounding insulation material. The cones contract within the holes through the insulation material without rupturing, and thereby maintain seals that prevent hot gases from entering the safe through the holes until the heat absorbing capability of the insulation material is exhausted.

The internal and external shells can be integrally formed as double-walled shells by blow molding. However, the truncated portions of the cones are preferably attached to the external shells by compression molding. Inner and outer mold parts that define between them a blow mold cavity are also used to perform the compression molding operation by closing together. For example, the truncated portions of the cones formed in the internal shells and adjacent portions of the external shells can be squeezed between the two mold parts to a thickness equal to about two-thirds of the combined thickness of the two shells.

One or more of the attached cones are located in positions that help to prevent the internal and external shells of the double-walled shells from bowing apart while being filled with the insulation material. As a result, the shells can be filled with a more closely toleranced volume of insulation material. Integrally molded funnels that project from the double-walled shells for filling the shells with insulation material can be cut off to a final height above the external shells before the shells are filled with the insulation material. The funnels are sized to hold only a small volume of overflow insulation material for preventing any gaps from forming between the insulation material and the shells while the insulation material is cured.

Since the funnels are cut off at their final height, escutcheon plates can be mounted over the funnels immediately after the shells are filled. The escutcheons are made with stakes having "mushroomed" or other shaped ends or mechanical attachments such as speed nuts, lock washers, and push nuts, any of which can be embedded in the insulation material before the insulation material has hardened in place. The stakes extend only part way through the insulation material and do not penetrate the internal shell.

The escutcheons can be made with baffles that surround the funnels to provide a more complete vapor barrier against evaporation of water from the insulation material through the funnels. This permits the insulation material to be cured more quickly by reducing evaporative cooling and containing exothermic heat. In addition, opposite sides of the funnels are arranged to provide a "snap-fit" or similar interference engagement with mating baffles of the escutcheons. However, the baffles of at least one of the escutcheons for covering funnels in the safe body and closure are sized to permit some adjustment between the escutcheons to align the latching mechanism.

Any drilling through the external shells required to mount the latching mechanisms can take place before the shells are filled with insulation material. Tape or other forms of temporary seals can be used to cover the holes while the shells are filled. Posts supporting the latching mechanisms can be made with pointed ends for penetrating the temporary seals; and, thereafter, the posts can be embedded in the insulation material before the material is hardened in place.

DRAWINGS

Figure 7:
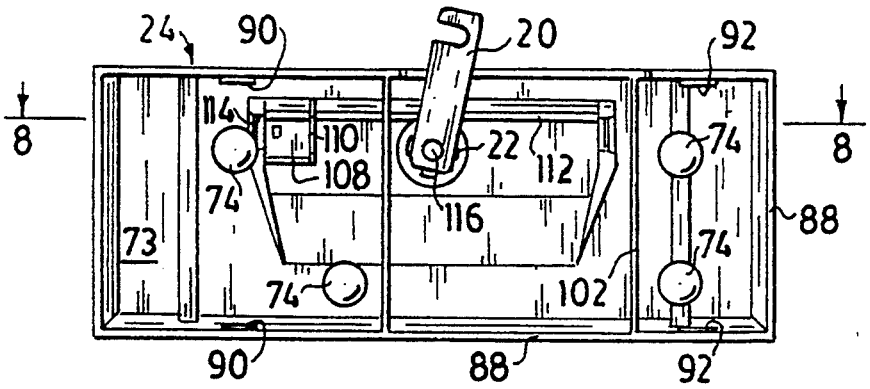
FIG. 7 is a plan view showing interior features of a lower escutcheon.
Figure 8:
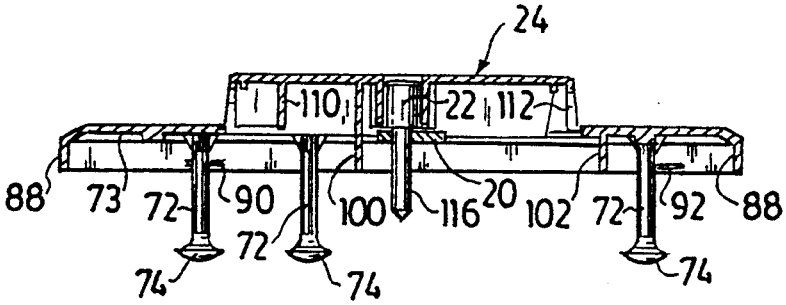

FIG. 8 lisa cross-sectional side view taken along line 8—8 of FIG. 7 showing the interior features of the lower escutcheon from an orthogonal perspective.

Figure 9:
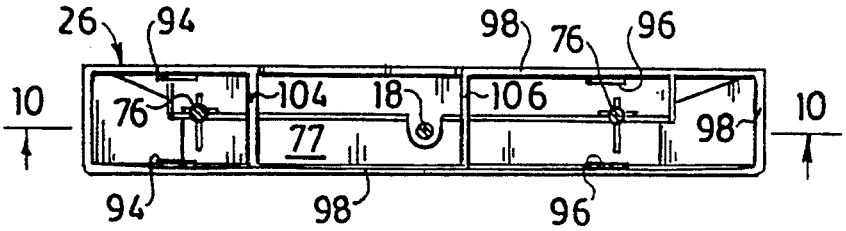

FIG. 9 is a plan view partly in section showing interior features of an upper escutcheon.

Figure 10:
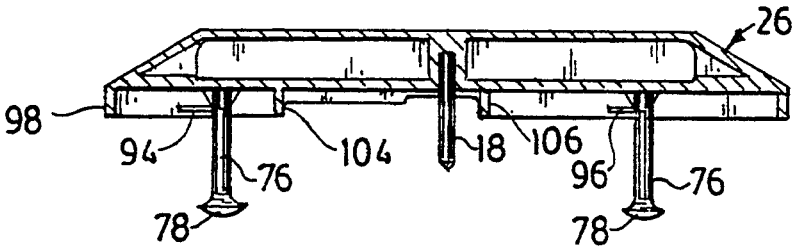

FIG. 10 is a cross-sectional side view taken along line 10—10 of FIG. 9 showing the interior features of the upper escutcheon from an orthogonal perspective.

Figure 11:
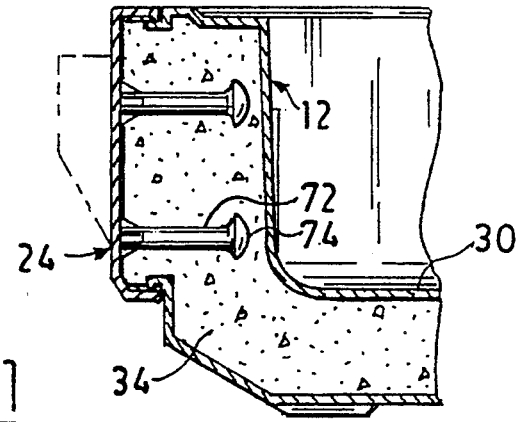

FIG. 11 is a broken-away cross-sectional view of a portion of the base showing how the lower escutcheon is attached.

Figure 12:
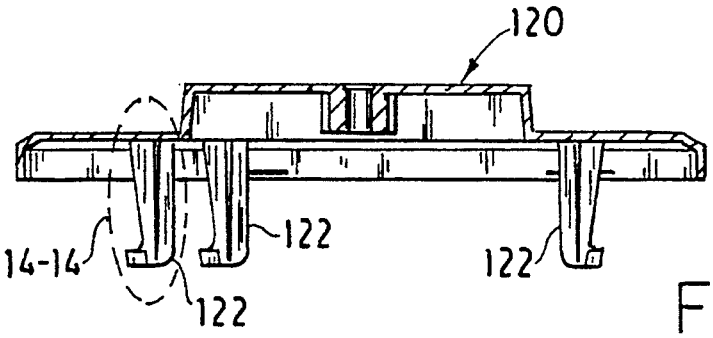

FIG. 12 is a cross-sectional side view similar to FIGS. 8 and 10, but showing an alternative escutcheon.

Figure 13:
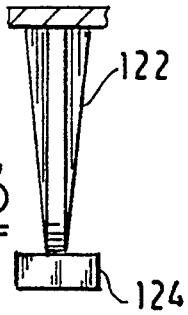

FIG. 13 is an enlarged front view of a stake shown in FIG. 12.

Figure 14:
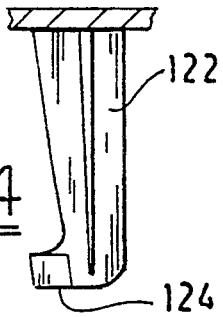

FIG. 14 is an enlarged side view of the same stake.

Figure 15:
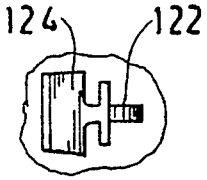

FIG. 15 is an enlarged end view showing further details of the stake.

Figure 16:
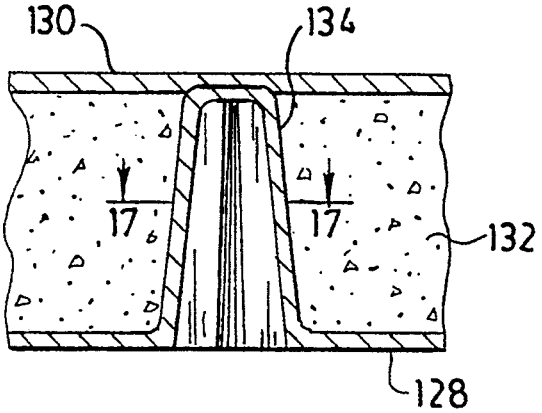

FIG. 16 is a broken-away cross-sectional view of a similar case showing an alternatively shaped hollow reinforcement.

Figure 17:
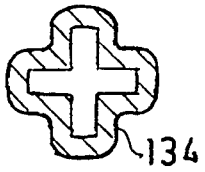

FIG. 17 is a cross-sectional view of the alternative hollow reinforcement taken along line 17—17 of FIG. 16.

Figure 18:
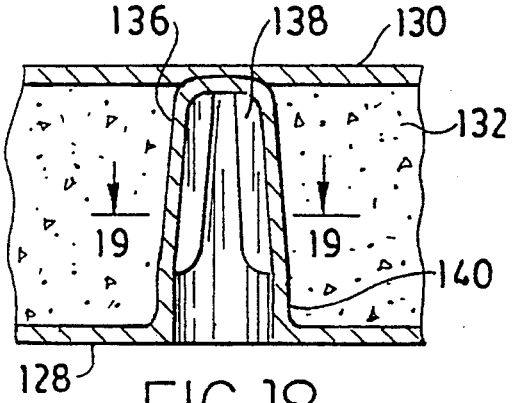

FIG. 18 is a view similar to FIG. 16, but showing a second alternatively shaped hollow reinforcement.

Figure 19:
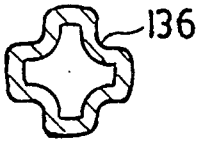

FIG. 19 is a cross-sectional view of the second alternative hollow reinforcement taken along line 19—19 of FIG. 18.

Figure 20:
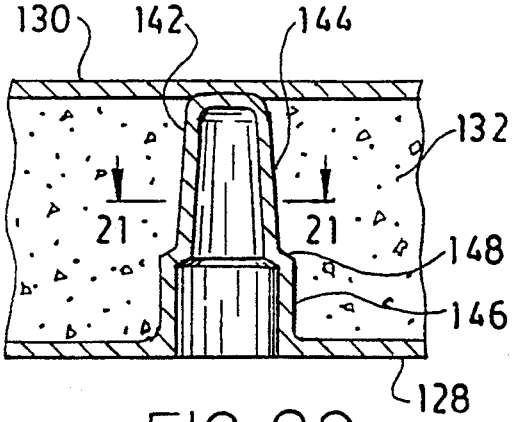

FIG. 20 is another view similar to FIG. 16, but showing a third alternatively shaped hollow reinforcement.

FIG. 214 is a cross-sectional view of the third alternative hollow reinforcement taken along line 21—21 of FIG. 20.

DETAILED DESCRIPTION

Figure 1:
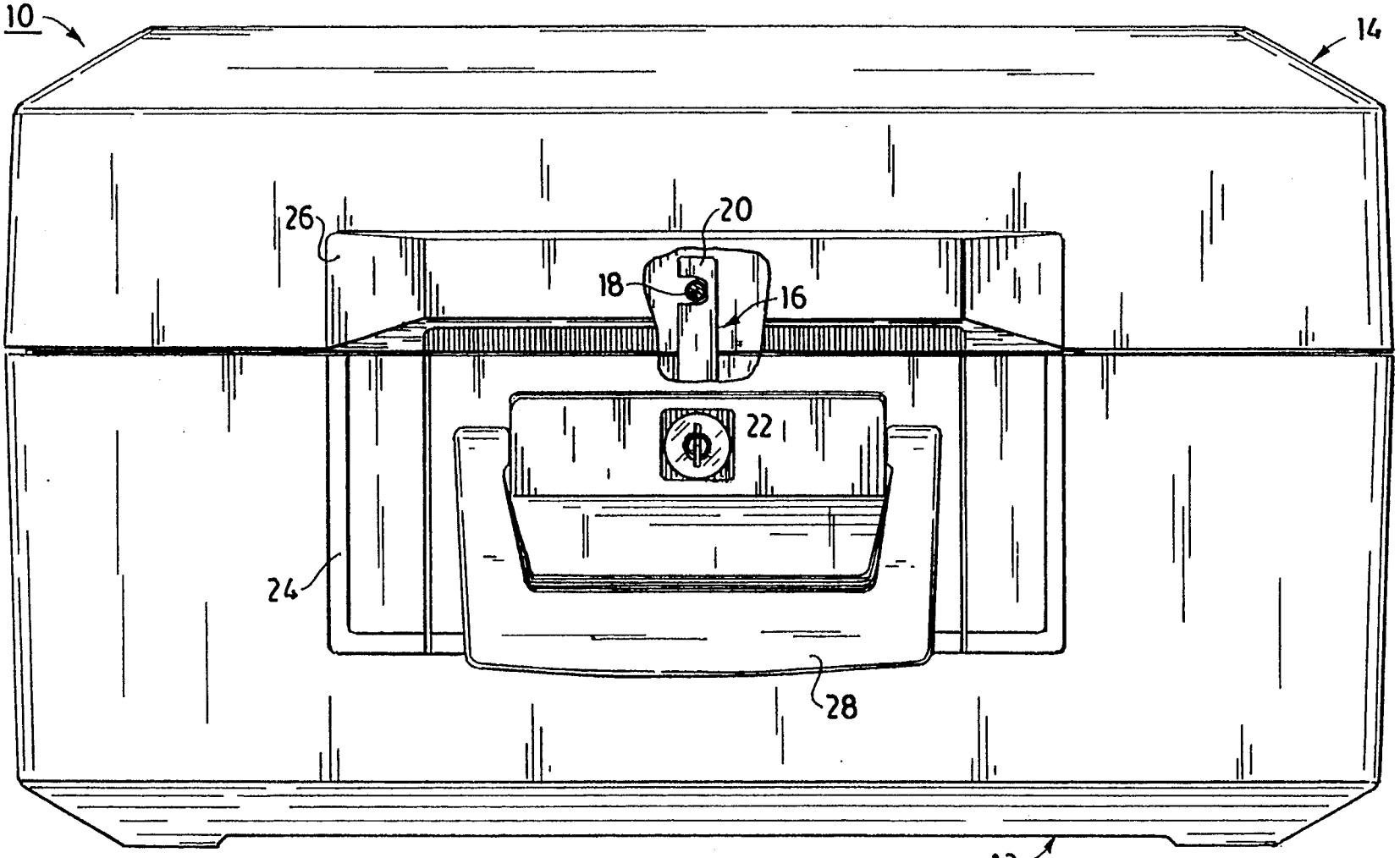
FIG. 1 is a front view of a fire-resistant case having a base covered by a lid as an example of a fire-resistant safe that can derive particular benefits from our invention.

One example of our invention as a fire-resistant case is depicted in the drawing figures. The case 10 is shown in FIG. 1 with a base 12 and a lid 14 that are hinged together according to conventional practices. The base 12 and lid 14 are also held together by a latching mechanism 16 that includes a pin 18 and a hook 20 rotatable about a key operated lock 22.

An upper escutcheon 26 covers the pin 18 and part of the hook 20 but also provides sufficient clearance for the nook 20 to move into and out of engagement with the pin 18. A lower escutcheon 24 mounts the key operated lock 22 and covers the remaining part of the hook 20. A handle 28 is attached to the lower escutcheon 26 for carrying the case 10.

Figure 2:
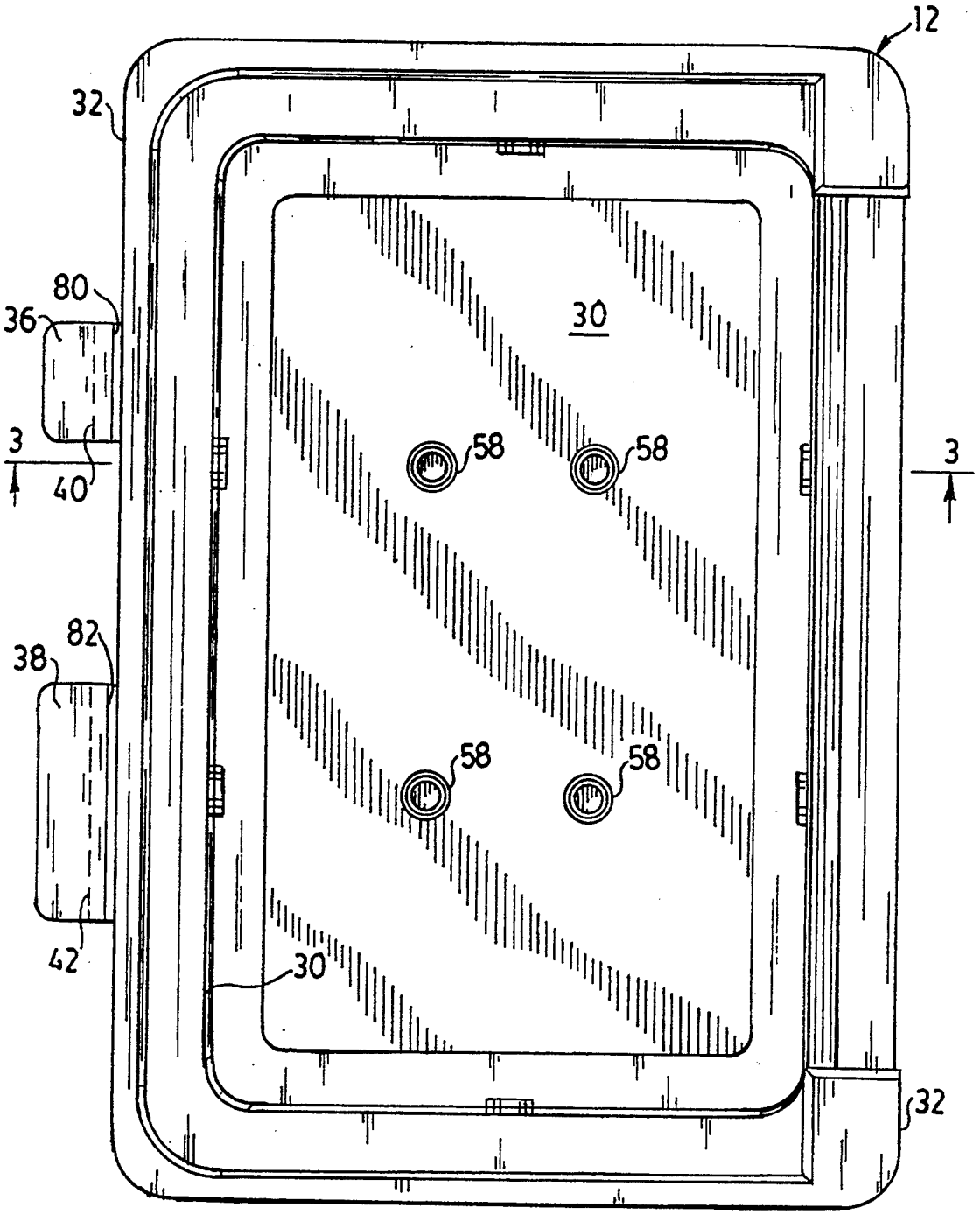
FIG. 2 is a plan view of the base with a pair of funnels as they would appear after a conventional blow molding operation.
Figure 3:
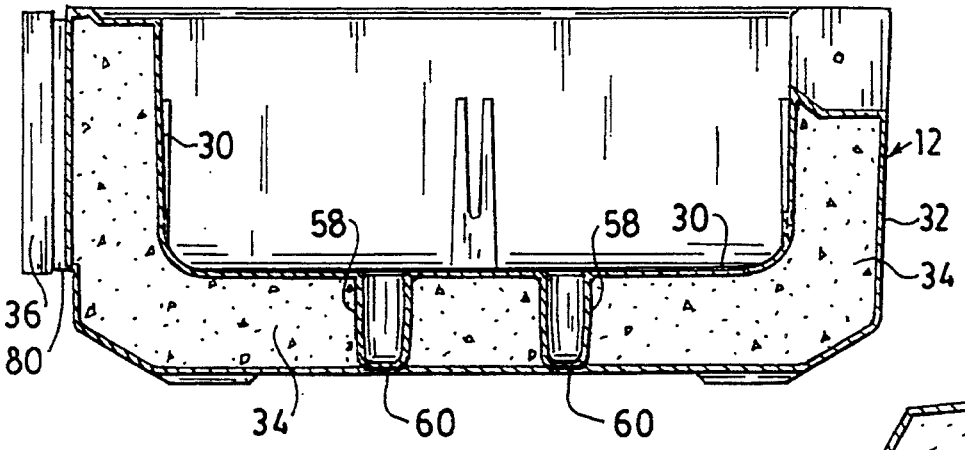
FIG. 3 is a cross-sectional view taken along line 3—3 of FIG. 2 showing the base filled with insulation material and the funnels of the base trimmed to their final height.

The base 12 as shown in FIGS. 2 and 3 includes a blow-molded resin body made up of internal shell 30 and external shell 32. The internal shell 30 encloses an interior space for storing contents of the case, and the external shell 32 forms the exterior of the base. The internal shell 30 and the external shell 32 also form respective interior and exterior walls that encapsulate a space between them filled with insulation 34.

U.S. Pat. No. 4,263,365, belonging to the assignee of this application, discloses a suitable insulation material composed of a mixture of water, Portland cement, cellulose fibers, and a foaming agent. The insulation 34 absorbs heat energy to which the base 12 is exposed by changing the water in the mix from a liquid state to a vapor state at 100 degrees centigrade—the boiling point of water.

Funnels 36 and 38 project from the external shell 32 for filling the space between the two shells with the insulation 34. The funnel 38 is larger than the funnel 36 and is used to guide the insulation 34 in a liquid state into the space between the shells. The smaller funnel 36 allows air to escape from the space while the shells are filled. Both of the funnels 36 and 38 are depicted as they would appear following the blow molding operation for making the internal and external shells. However, prior to filling the shells, the funnels are trimmed by a sawing operation along respective cutoff lines 40 and 42 to a final height above the external shell 32.

Figure 5:
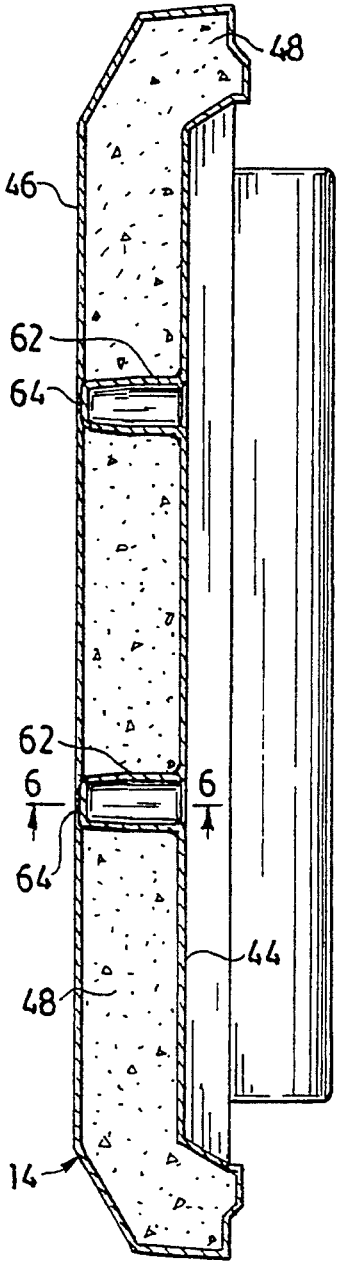
FIG. 5 is a cross-sectional view taken along line 5—5 of FIG. 4 showing the lid filled with insulation material.
Figure 4:
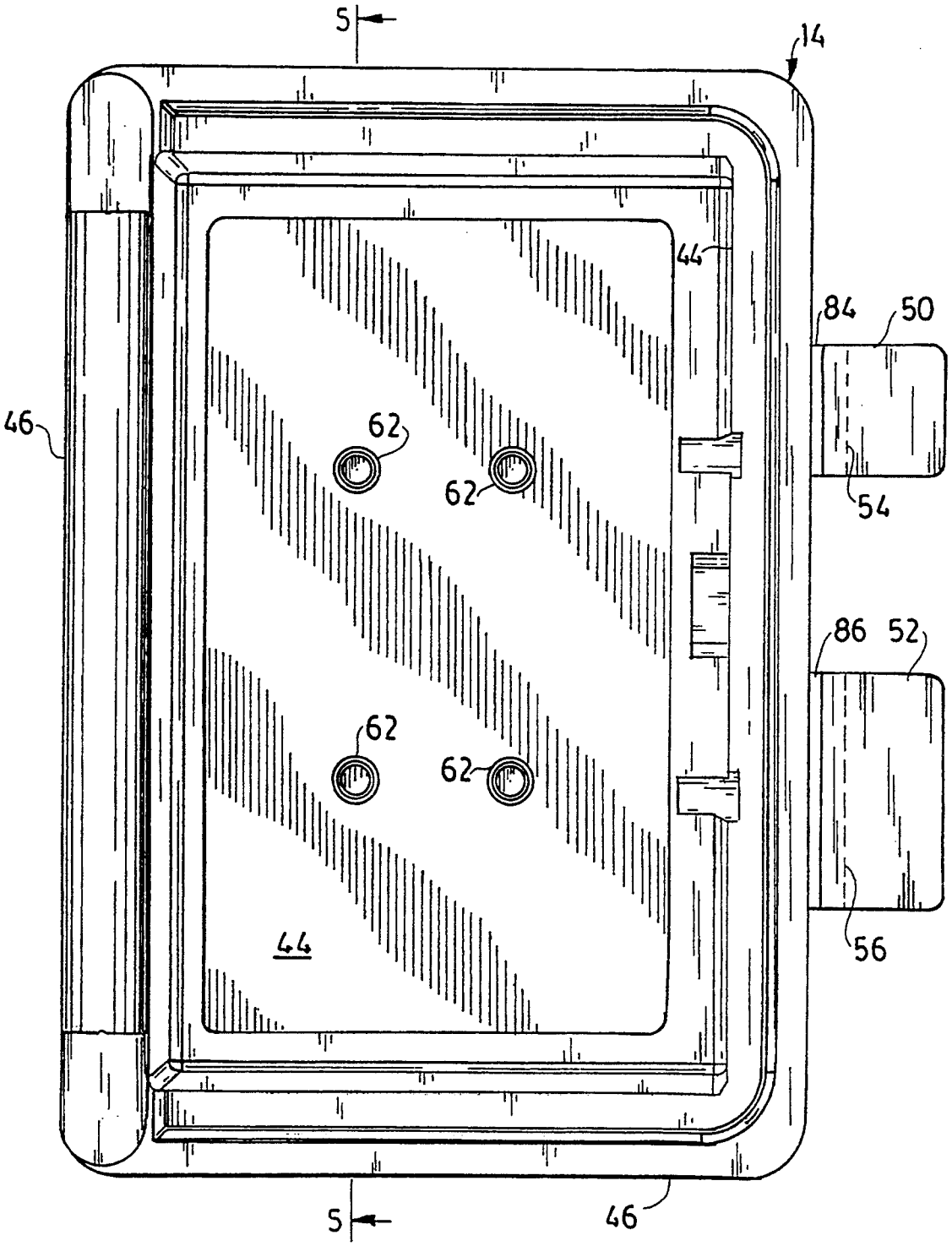
FIG. 4 is a plan view showing the inside of the lid with a pair of funnels as they would appear following a conventional blow molding operation.

The lid 14 as shown in FIGS. 4 and 5 is similarly constructed with a blow-molded resin body made up of internal shell 44 and external shell 46. The internal shell 44 lines the interior of the lid, and the external shell 46 forms the exterior of the lid. The internal shell 44 and the external shell 46 also form respective interior and exterior walls for containing insulation 48 within a space defined between the shells. The insulation 48 is composed of a mixture similar to the above-described mixture of insulation 34.

Similar to the base 12, the lid 14 is molded with two funnels 50 and 52 projecting from the external shell 46. The funnel 52 is the larger of the two funnels and is used for guiding the insulation 48 into the space between the shells, whereas the funnel 50 allows air to escape from the same filling space. Also, the two funnels 50 and 52 are trimmed along respective cutoff lines 54 and 56 to a final height above the external shell 46 prior to filling the shells with the insulation 48.

The insulation 34, 48 in the base 12 and lid 14 forms a nearly continuous layer for protecting contents stored in the case 10. However, our invention provides for interrupting this nearly continuous layer by forming hollow reinforcements through the insulation interconnecting the internal and external shells of the base and lid, respectively. For example, cone-shaped recesses 58 are formed in the internal shell 30 of the base. The cone-shaped recesses 58 form complementary holes through the insulation 34, and truncated bottom portions 60 of the recesses are attached to the external shell 32. Similar cone-shaped recesses 62 are formed in the internal shell 44 of the lid. The cone-shaped recesses 62 form holes through the insulation 48 and include truncated bottom portions 64 attached to the external shell 46.

The cone-shaped recesses 58 and 62 provide structural reinforcements for maintaining a predetermined spacing between the internal 30, 44 and external 32, 46 shells of the base and the lid, respectively. This reinforcement prevents bowing between the internal and external shells and enables the shells of the base and the lid to be filled with predetermined amounts of liquid insulation material. In addition, the recesses 58 and 62 help to anchor the hardened insulation 34, 48 in place within the respective shells of the base and the lid.

Figure 6:
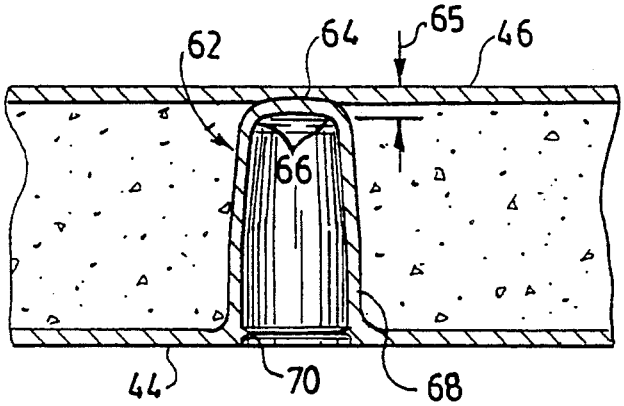
FIG. 6 is an enlarged cross-sectional view taken along line 6—6 of FIG. 5 through one of the hollow reinforcements shown in FIGS. 4 and 5.

The enlarged view of FIG. 6 shows more of the features of the cone-shaped recesses 58 and 62. The truncated bottom portion 64 of the depicted recess 62 is compression molded together with the external shell 46 to a combined thickness 65 that is equal to about two-thirds of the total thickness of both shells. The area of contact between the truncated bottom portion and the external shell is preferably at least one-half centimeter in diameter. Radiused portions 66, joining the truncated bottom portion 64 to the rest of the recess 62, prevent the resin material from thinning in this portion of the recess during the blow molding operation.

The cone-shaped recess 62 is also formed with a short cylindrical section 68 and a lip 70 for receiving a conventional plug (not shown) with a snap-fit engagement. Although the conventional plugs are not required for fire protection, the plugs are used to cover the holes through the insulation material so that the holes do not need to be explained to customers. However, the holes can also be used to support dividers or perform other functions unrelated to fire protection. The short cylindrical section 68 of the recesses also provides for better anchoring the recesses in the insulation material 48 and for resisting shear forces between the insulation material and resin shells.

The resin material of the blow-molded shells can be a high-density polyethylene material that has a melting point at about one-hundred-thirty degrees centigrade, which is above the temperature at which water is vaporized from the insulation. Upon exposure to the high temperatures of fire, the external shells 32 and 46 quickly soften and melt. The truncated bottom portions, 60 and 64 of the recesses separate from the external shells and begin to contract without rupturing toward a planar form.

However, the presence of water in the insulation material surrounding the recess retards the contraction of the recess by limiting temperature increases in the resin material to below the melting point of the resin material. Nevertheless, as the water is gradually vaporized from progressively deeper areas of the insulation material, the resin material contracts deeper into the insulation material following the depth of the remaining water. In other words, the recesses contract at a rate that parallels the vaporization of water from the surrounding insulation material and, thereby, maintain seals that prevent hot gases from entering the case until the protection provided by the insulation material is exhausted.

The hollow reinforcements, e.g., the cone-shaped recesses 58 and 62, also provide a basis for significantly improving the manufacture of fire-resistant safes. For example, since the cone-shaped recesses 58 and 62 help to maintain predetermined spacings between the internal 30, 44 and the external 32, 46 shells of the base and lid, the shells can be filled with predetermined amounts of insulation material only slightly in excess of the volumes of insulation material expected to completely fill the respective shells. Accordingly, prior to filling the shells, the funnels 36, 38 and 50, 52 of the base and lid can be trimmed to final heights above the external shells 32 and 46 along cutoff lines 40, 42 and 54, 56. This eliminates a second sawing operation previously required to trim both the funnels and hardened insulation material to the desired height.

FIGS. 7–11 depict details of two new escutcheons that can be used to derive further benefits from the use of hollow reinforcements. The lower escutcheon 24 (see also FIG. 1) is sized to cover the funnels 36 and 38 of the base, and the upper escutcheon 26 is sized to cover the funnels 50 and 52 of the lid. Both of the escutcheons 24 and 26 can be injection molded from a styrene material.

The lower escutcheon 24 is molded with four stakes 72, two of which are positioned to fit within the funnel 36 and the other two are positioned to fit within the funnel 38. Each of the stakes projects from a base plate 73 and is fitted with an enlarged or "mushroomed" end 74 that is designed to anchor the stakes 72 within the hardened insulation material 34. The mushroomed ends 74 can be attached to the stakes 72, the stakes can be shaped by heat or ultrasonic vibration, or the mushroomed ends 74 can be made integrally with the stakes using articulated molds.

The upper escutcheon 26 is similarly molded with two stakes 76, one of which is positioned to fit within the funnel 50 and the other is positioned to fit within the funnel 52. Both stakes project from a base plate 77 and are fitted with mushroomed ends 78 similar to the ends of stakes 72.

Since the funnels 36, 38 and 50, 52 of the base and lid are already trimmed to their final height when the shells of the base and lid are filled with insulation material, the lower and upper escutcheons 24 and 26 can be mounted before the insulation material has cured to a hardened state. Accordingly, the stakes 72 and 76 of the two escutcheons are embedded in the insulation material before the material solidifies (see for example FIG. 11). The mushroomed ends 74 and 78 of the stakes anchor the respective escutcheons 24 and 26 to the base and lid without penetrating the internal shells 30 and 44. This eliminates previously required drilling operations through hardened insulation material and the unsightly use of fasteners within prior safes to attach escutcheons.

Both escutcheons 24 and 26 are also mounted with an adjustable snap-fit engagement with the funnels 36, 38 and 50, 52 to hold the escutcheons in place while the insulation material cures. Below each of the cutoff lines 40, 42, 54, and 56, the funnels are undercut with respective pairs of grooves 80, 82, 84, and 86 that extend along opposite sides of the funnels. The lower escutcheon 24 includes an outer rim 88 surrounding the base plate 73 having two pairs of detents 90 and 92 for respectively engaging the pairs of grooves 80 and 82. Similarly, the upper escutcheon 26 has two pairs of detents 94 and 96 formed in an outer rim 98 surrounding the base plate 77 for respectively engaging the pairs of grooves 84 and 86. At least one of the outer rims 88 and 98 is sized to permit longitudinal adjustment along the grooves to align the hook 20 with the pin 18 of the latching mechanism 16.

The two escutcheons 24 and 26 are also molded with baffles which, together with the respective outer rims 88 and 98, enclose the open ends of the funnels to reduce evaporation of water from the insulation material through the funnels. For example a baffle 100, together with the outer rim 88 of the lower escutcheon, encloses the funnel 38 of the base. Another baffle 102 joins opposite sides of the rim 88 to enclose the funnel 36. Within the upper escutcheon 26, baffles 104 and 106 cooperate with outer rim 98 to respectively enclose funnels 50 and 52. Two other baffles 108 and 110 join with a recess 112 formed in the base plate 73 to enclose an opening 114 in the lower escutcheon for mounting the handle 28.

The latching mechanism 16 is mounted within the two escutcheons. The key operated lock 22 is mounted in the lower escutcheon and is rotatable about a pin 116 that is embedded in the insulation 34. Similarly, the pin 18 of the latching mechanism is mounted in the upper escutcheon and is embedded in the insulation 48. Neither pin 116 nor pin 18 is positioned over a funnel.

Accordingly, holes must be made through the external shells 32 and 46 to admit the pins into the insulation. However, the holes can be drilled through the external shells before the shells are filled with insulation. This replaces previously required drilling operations through both the external shells and hardened insulation material for each pin. Tape or another kind of plug can be used to close the holes while the shells are filled with insulation material to the predetermined height above the shells. The pins 116 and 18 are made with pointed ends to penetrate the plugs for embedding the pins along with the stakes 72 and 76 in the insulation material before the material has hardened in place.

Since the two escutcheon plates 24 and 26 can be mounted in place immediately after the shells of the base and lid are filled with insulation material, the insulation material can be cured at an elevated temperature for a longer period of time without excessive water loss from the insulation material. The baffles formed in the escutcheons enclose the funnels to further reduce water losses from the insulation material. This shortens the total amount of time required to completely cure the insulation material.

Also, in contrast to the usual practice of clamping several cases together between braces until the insulation is cured to a hardened state for maintaining a tolerance for flatness in the external shells, the case 10 can be assembled and appropriately braced within a shipping box before the insulation is completely cured. This further diminishes the time required to manufacture the cases.

FIGS. 12–15 depict an alternative escutcheon 120 distinguished by stakes 122 that are specially shaped for molding convenience. The stakes 122 are generally cross-shaped in length and terminate with enlarged ends 124 that extend perpendicular to the length of the stakes.

The remaining figures show three variations of the generally cone-shaped recesses that are used in our invention for interconnecting internal and external shells of fire-resistant safes. For purposes of comparison, all three variations are shown in respective sections connecting internal shell 128 to external shell 130 through insulation material 132.

In FIGS. 16 and 17, a recess 134 formed in the internal shell 128 is cross-shaped in section. The cross-shaped recess 134 surrounds a hollow space through the insulation 132 with additional resin material and exposes the resin material surrounding the hollow space to additional surface area of the insulation. The additional mating area between the resin material of the cross-shaped recess 134 and the surrounding insulation 132 helps to protect the resin material from fire and to hold the insulation 132 and the internal shell 128 together in a fire.

FIGS. 18 and 19 depict a modified form of the cross-shaped recess of the immediately preceding drawing figures. However, the modified recess 136 is made with two distinct portions. A bottom portion 138 has a rounded cross-shaped configuration and a top portion 140 (bottom and top portions shown inverted) has a cylindrical shape.

Figure 21:
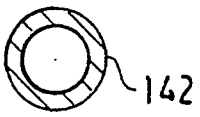

Finally, FIGS. 20 and 21 depict a recess 142 that is also made from two distinct sections—bottom portion 144 is cone-shaped and top portion 146 is cylindrically shaped. However, the two portions have different adjacent diameters and are joined by a stepped portion 148.

We claim:

1. An escutcheon for covering a funnel in a double-walled fire-resistant safe filled with insulation material comprising:

a plate surrounded by a rim that encloses an interior space of the escutcheon;

a baffle that is interconnected with said rim for enclosing the funnel to resist evaporation of water from the insulation material through the funnel; and a stake projecting from said plate for anchoring the escutcheon in the insulation material before the insulation material has completely hardened into place,

2. The escutcheon of claim 1 further comprising means for attaching the escutcheon to the funnel with an interference engagement.

3. The escutcheon of claim 2 in which said means for attaching includes detents formed in said rim for engaging grooves formed in the funnel with a snap-fit engagement,

4. The escutcheon of claim 3 in which said rim is sized to permit adjustment of the escutcheon along said grooves,

5. The escutcheon of claim 1 further comprising a second baffle for enclosing another funnel.

6. The escutcheon of claim 5 further comprising a second stake for anchoring the escutcheon in the insulation material before the insulation material has completely hardened into place.

7. The escutcheon of claim 6 in which said stakes are positioned for entering the insulation material through the respective funnels.

8. The escutcheon of claim 7 in which said stake has an enlarged portion for anchoring the stake in the insulation material.

9. The escutcheon of claim 1 further comprising a recess formed in said plate with openings for supporting a handle and another baffle cooperating with said recess for enclosing one of said openings.

10. A method of making a fire-resistant safe comprising the steps of:

joining internal and external shells with a recess formed in the internal shell having a bottom portion that is attached to the external shell for maintaining the internal and external shells at a predetermined spacing;

filling a space defined between the internal and external shells with a predetermined amount of insulation material through a funnel formed in the external shell; and anchoring an escutcheon for covering the funnel to the insulation material by stakes that are embedded in the insulation material before the insulation material is completely hardened into place, wherein said anchoring step includes inserting the stakes through the funnel into the insulation material.

11. The method of claim 10 including the further step of integrally forming the internal and external shells by blow molding.

12. The method of claim 11 in which said joining step includes attaching the bottom portion of the recess to the external shell by compression molding.

13. The method of claims 10 including the further step of trimming the funnel to a final height above the external shell before executing said filling step.

14. The method of claim 13 in which said anchoring step includes fastening the escutcheon in place about the funnel.

15. The method of claim 10 including the further step of mounting a latching mechanism within the escutcheon.

16. The method of claims 15 in which said anchoring step includes embedding a pin of the latching mechanism in the insulation material before the insulation material is completely hardened into place.

17. The method of claims 16 including the further step of forming a hole in the external shell for receiving the pin of the latching mechanism before executing said filling step.

* * * * *